US010006176B2

(12) United States Patent
Bermingham et al.

(10) Patent No.: US 10,006,176 B2
(45) Date of Patent: Jun. 26, 2018

(54) METHOD FOR BUILDING A BRIDGE AND BRIDGE-BUILDING APPARATUS

(71) Applicant: SOLENTANCHE FREYSSINET, Rueil Malmaison (FR)

(72) Inventors: Patrick D. Bermingham, Ancaster (CA); Erik Mellier, Viroflay (FR); Stefano L. Gabaldo, Hamilton (CA); Brice Le Treut, Aix-en-Provence (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days. days.

(21) Appl. No.: 15/316,370

(22) PCT Filed: Jun. 6, 2014

(86) PCT No.: PCT/IB2014/001342
§ 371 (c)(1),
(2) Date: Dec. 5, 2016

(87) PCT Pub. No.: WO2015/185959
PCT Pub. Date: Dec. 10, 2015

(65) Prior Publication Data

US 2017/0175347 A1 Jun. 22, 2017

(51) Int. Cl.

| | |
|---|---|
| ***E01D 19/00*** | (2006.01) |
| ***E01D 21/06*** | (2006.01) |
| ***B66C 19/00*** | (2006.01) |
| ***B66C 23/26*** | (2006.01) |
| *E01D 19/02* | (2006.01) |

(52) U.S. Cl.
CPC ..... *E01D 21/06* (2013.01); *B66C 19/00* (2013.01); *B66C 23/26* (2013.01); *E01D 19/02* (2013.01)

(58) Field of Classification Search
CPC ..... E01D 21/06; E01D 19/02; B66C 19/00; B66C 23/26
USPC ..... 14/77.1–78, 13
See application file for complete search history.

(56) References Cited

U.S. PATENT DOCUMENTS

| | | | | |
|---|---|---|---|---|
| 3,385,455 | A * | 5/1968 | Dal Pont Eugenio | B66C 23/00 14/77.1 |
| 3,579,759 | A | 5/1971 | Zuccolo | |
| 3,902,212 | A * | 9/1975 | Muller | E01D 21/105 14/77.1 |

(Continued)

FOREIGN PATENT DOCUMENTS

| | | | |
|---|---|---|---|
| DE | 100 46 681 | A1 | 4/2002 |
| JP | 2001-131918 | A | 5/2001 |
| WO | 2007/076417 | A2 | 7/2007 |

*Primary Examiner* — Raymond W Addie
(74) *Attorney, Agent, or Firm* — Dentons US LLP

(57) ABSTRACT

A method for building a bridge, said bridge comprising piers and at least one deck. The method including a cantilever step, wherein a girder is set in a cantilevered position relative to a bank or to a constructed zone of the bridge so that the girder comprises a first end overhanging the bank or the constructed zone, and a second end overhanging a construction zone of the bridge, and a construction step, wherein pier elements and deck elements are installed in said construction zone via a first and a second lifting devices mounted movable on the girder between the first and second ends. The first and second lifting devices cross one another along the girder during the cantilever step and/or during the construction step.

12 Claims, 8 Drawing Sheets

(56) References Cited

U.S. PATENT DOCUMENTS

| | | | | | |
|---|---|---|---|---|---|
| 4,103,861 | A * | 8/1978 | Buchler | E01D 21/105 | 14/77.1 |
| 4,282,975 | A * | 8/1981 | Ovadia | A47F 7/02 | 206/443 |
| 4,497,153 | A * | 2/1985 | Muller | E01D 21/00 | 14/77.1 |
| 5,511,268 | A * | 4/1996 | Albus | E01D 21/06 | 14/77.1 |
| 5,960,502 | A * | 10/1999 | Sherman | E01D 21/06 | 14/77.1 |
| 6,721,985 | B2 * | 4/2004 | McCrary | B60L 3/0046 | 14/77.1 |
| 7,401,371 | B2 * | 7/2008 | Kornatsky | E01C 1/002 | 14/77.1 |
| 8,166,596 | B2 * | 5/2012 | Kang | E01D 21/06 | 14/77.1 |
| 8,671,490 | B1 * | 3/2014 | Carney | B66C 19/005 | 14/2.4 |
| 2004/0148717 | A1 * | 8/2004 | Kornatsky | E01C 1/002 | 14/77.1 |
| 2007/0163058 | A1 * | 7/2007 | Homsi | E01D 19/103 | 14/77.1 |

* cited by examiner

METHOD FOR BUILDING A BRIDGE AND BRIDGE-BUILDING APPARATUS

This application is a National Stage Application of International Application No. PCT/IB2014/001342, filed on Jun. 6, 2014, which is hereby incorporated by reference in its entirety for all purposes as if fully set forth herein.

BACKGROUND OF THE INVENTION

The invention relates to a method for building a bridge and a bridge-building apparatus.

Bridges typically comprise a substructure in the form of piers which are laid out vertically and are inserted in the ground, and a superstructure which comprises a deck which extends between the piers and defines a path for effectively crossing the bridge.

The construction of such bridges potentially relies on the use of a girder to be cantilevered relative to a constructed zone of the bridge, and on which two or more movable lifting devices circulate so as to pick up and transfer bridge elements between the constructed zone of the bridge and a construction zone located in the vicinity of the cantilevered end of the girder.

However, it has been found that the known methods for building such bridges have drawbacks. In fact, for the most part, the building of the piers and the building of the deck are generally planned as two separate tasks to each of which one of the lifting devices is assigned. These two devices are then mostly used in a sequential manner, which translates into a substantial overall building duration.

It is an object of the present invention to solve the above-described problem and to provide an improved method for building a bridge and an improved apparatus for building a bridge.

SUMMARY OF THE INVENTION

The invention relates to a method for building a bridge, said bridge comprising piers and at least one deck, the method comprising:

- a cantilever step, wherein a girder is set in a cantilevered position relative to a bank or to a constructed zone of the bridge so that the girder comprises a first end overhanging said bank or said constructed zone, and a second end overhanging a construction zone of the bridge,
- a construction step, wherein pier elements and deck elements are installed in said construction zone via a first and a second lifting devices mounted movable on the girder between the first and second ends, wherein the first and second lifting devices cross one another along the girder during the cantilever step and/or during the construction step.

This translates into a minimized time window during which the lifting devices operate sequentially, and therefore tends to minimize the duration of the building process as a whole.

According to another aspect of the invention, the construction step comprises the installation of part of the deck elements via the first lifting device and, at the same time, the installation of part of the pier elements via the second lifting device.

In another embodiment, construction tools are moved along the girder by a movable rack mounted movable on the girder.

Yet, according to another aspect of the invention, the method also comprises:

- installing a cofferdam in the construction zone of the bridge;
- setting the second end of the girder on the cofferdam so that said second end rests on the cofferdam;
- installing pier elements inside the cofferdam.

A bearing system configured to monitor and adjust the geometrical and/or the load configuration of the interface between the girder and said cofferdam may be arranged between the cofferdam and the girder for the construction of said pier.

In one aspect of the invention, during at least part of the installation of the cofferdam, the second lifting device is located at the first end of the girder and the first lifting device is located at the second end of the girder, and, during at least part of the construction of said pier, the second lifting device is located at the second end of the girder and the first lifting device is located at the first end of the girder.

The invention also relates to a bridge-building apparatus, said bridge comprising piers and at least one deck, said apparatus comprising:

- a girder having a first end configured to overhang a bank or a construction zone of the bridge, and a second end configured to overhang a construction zone of the bridge, and
- a first and a second lifting devices movable on guides laid out on the girder between the first and second ends for the moving of pier elements and deck elements between the constructed zone and the construction zone of the bridge, said guides being configured to allow the crossing of the first and second lifting devices along the girder.

The guides may comprise a set of rails defining at least two independent running tracks between the first and second ends of the girder.

In accordance with another aspect of the invention, the girder comprises a storage rack, the storage rack being independent of the lifting devices and movable along the girder, said storage rack being adapted to move construction tools along the girder.

In particular embodiments, the girder has a length corresponding to substantially three times the distance between two consecutive piers of the bridge.

The girder may comprise at least one guiding frame for the vertical guiding of pier elements, said guiding frame being located at the second end of the girder.

The girder may comprise a front support adapted to rest on a cofferdam in the construction zone, the front support comprising a bearing system configured to monitor and adjust the geometrical and/or the load configuration of the interface between the girder and said cofferdam.

In other embodiments, the method and apparatus comprise one or more of the above features, whether considered alone or according to any possible combination.

In particular, the invention also relates to a method for building a bridge, said bridge comprising piers and at least one deck, the method comprising:

- a cantilever step, wherein a girder is set in a cantilevered position relative to a bank or to a constructed zone of the bridge so that the girder comprises a first end overhanging the bank or the constructed zone, and a second end overhanging a construction zone of the bridge,
- a construction step, wherein pier elements and deck elements are installed in said construction zone, wherein the method further comprises moving construction tools on the girder and along the girder via a movable rack mounted movable on the girder.

In fact, the sole use of the movable rack single-handedly contributes to solving the above-problem.

In addition, the invention relates to a bridge-building apparatus, said bridge comprising piers and at least one deck, said apparatus comprising:

- a girder having a first end configured to overhang a bank or a construction zone of the bridge, and a second end configured to overhang a construction zone of the bridge, and
- a movable rack mounted movable on the girder, said rack being configured to move construction tools along the girder.

BRIEF DESCRIPTION OF THE DRAWINGS

Further features and advantages of the invention will become more apparent by reading the following detailed description of the embodiments, which are given by way of non-limiting examples with reference to the appended drawings, in which:

FIG. 1*a* illustrates an apparatus 2 for building a bridge 4. The bridge may be built over water or over land. In the example of FIG. 1, the bridge 4 is built over water and rests on a seabed. The bridge 4 comprises piers 6 and at least one deck 8 made of deck segments 10 which define a path for crossing the bridge. The piers 6 are laid out vertically at regular intervals and form the supporting foundations of the bridge 4. The bridge 4 is a multi-span bridge, i.e. it exhibits a repeated pattern of piers and of deck sections over at least part of its entire length, the distance between two adjacent piers being known as a span of the bridge. Preferably, the span of the bridge is regular over at least part of the bridge, the distances between two adjacent piers being substantially constant over this portion. For instance, the bridge is designed to comprise several spans, such as 10, 20, 30 or more spans. In addition, the bridge 4 may comprise several decks 8 each made of deck segments 10. These decks may be connected together, forming one or more paths for crossing the bridge.

Figure 1A:
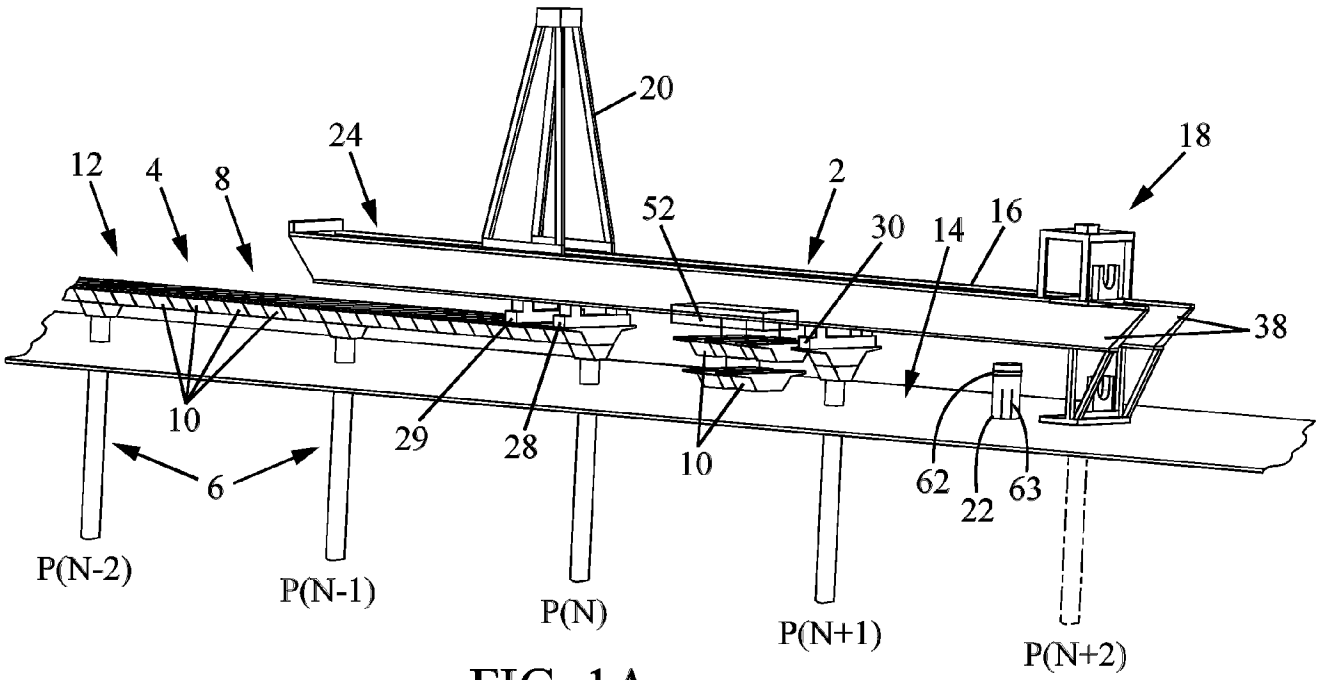
FIG. 1*a* is a perspective view of a bridge-building apparatus according to the invention.
Figure 1B:
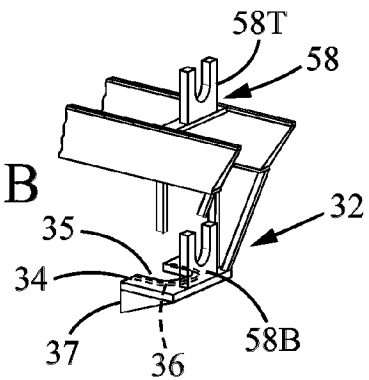
FIG. 1*b* illustrates a front support of a girder of the apparatus of FIG. 1.
Figure 1C:
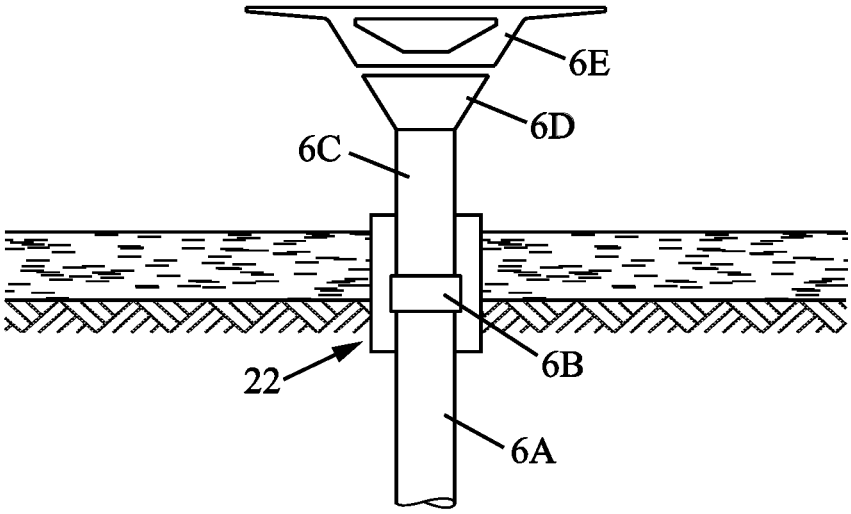
FIG. 1*c* illustrates an exemplary structure of a pier of FIG. 1.

Each pier is made of pier elements. For instance, in view of FIG. 1*c*, the pier elements comprise, from bottom to top:

- a steel or concrete pile 6A inserted in the seabed,
- a pile cap 6B for the connection of the pile 6A to the rest of the pier and located on top of the pile 6A,
- a pier column 6C (also known as a pier shaft) laid out on top of the pile cap 6B,
- a pier cap 6D (also known as a pier head) laid out on top of the pier column 6C, and
- a pier segment 6E located on top of the pier cap and forming part of the deck 8.

The pile 6A and the pile cap 6B form the foundations of the pier 6. Alternatively, a pier 6 may comprise a plurality of piles 6A, the pile cap 6B being therefore connected to all of the piles 6A.

In the following description, the piers 6 are referred to by an integer. The bridge 4 thus presents a constructed zone 12 which extends, or spans, up to a pier P(N) (left hand side of FIG. 1*a*) and in which both the deck and the piers are installed, and a construction zone 14 located beyond pier P(N) (right hand side of FIG. 1) in which the piers and/or the deck are to be installed next. In the example of FIG. 1, in the construction zone 14, pier P(N+1) has been erected, but the deck 8 has not been installed.

The apparatus 2 is adapted for building bridges over land as well as over water, whether shallow or deep. In particular, the apparatus 2 is adapted to build multi-span bridges, or the multi-span portions of bridges, these spans being roughly identical. In addition, as will become apparent, the apparatus is particularly adapted for building bridges made of precast or premade elements to be assembled together.

The bridge-building apparatus 2 comprises a girder 16, a first lifting device 18, a second lifting device 20 and a cofferdam 22.

The girder 16 forms the main structure of the apparatus 2. The girder is also known as a launching girder. The girder 16 extends along the axis of the bridge. The girder 16 presents a length which corresponds substantially to three times the distance between two consecutive piers of the bridge. That distance is also known as a span of the bridge. The girder is therefore shorter, less bulky and easier to manipulate than those of typical bridge-building systems which span over four bridge-spans. The girder 16 presents a first end 24 overhanging the constructed zone 12 or the bank from which the bridge 4 extends, and a second end 26 overhanging the construction zone 14. The first end 24 may be understood as the entire portion of the girder that is located above the constructed zone 12. The second end 26 may be understood as the entire portion of the girder overhanging the construction zone 14.

The girder 16 comprises support bearings. More precisely, the girder 16 comprises rear support bearings 28, 29 resting on the constructed zone 12 of the bridge, and an intermediate support bearing 30 either resting on an erected pier in the construction zone 14 or also resting on the constructed zone 12. For example, the rear and intermediate support bearings 28, 29, 30 are identical and in the form of beams. These bearing are configured to be selectively secured or detached from the girder 16, for instance for their moving to another position in the constructed zone 12 or in the construction zone 14. In addition, while secured to the girder 16, the rear and intermediate bearings 28, 29, 30 are movable relative to the girder. In other words, the girder 16 is movable relative to its rear and intermediate support bearings. As will be seen later, this allows for the launching of the girder over the construction zone so that the extremity of its second end 26 may be brought above the area in which a new pier is to be erected.

The girder 16 further comprises a front support 32 configured to serve as a support for the girder either on the cofferdam or on installed pier elements. The front support 32 is located beneath the extremity of the second end 26 of the girder 16. In view of FIG. 1*b*, the front support 32 comprises a floor plate 34 secured to the girder 16 via connection frames. The floor plate 34 is provided with a C-shaped opening 35 so as to allow both the piles 6A and the cofferdam through the floor plate 34.

Figure 1D:
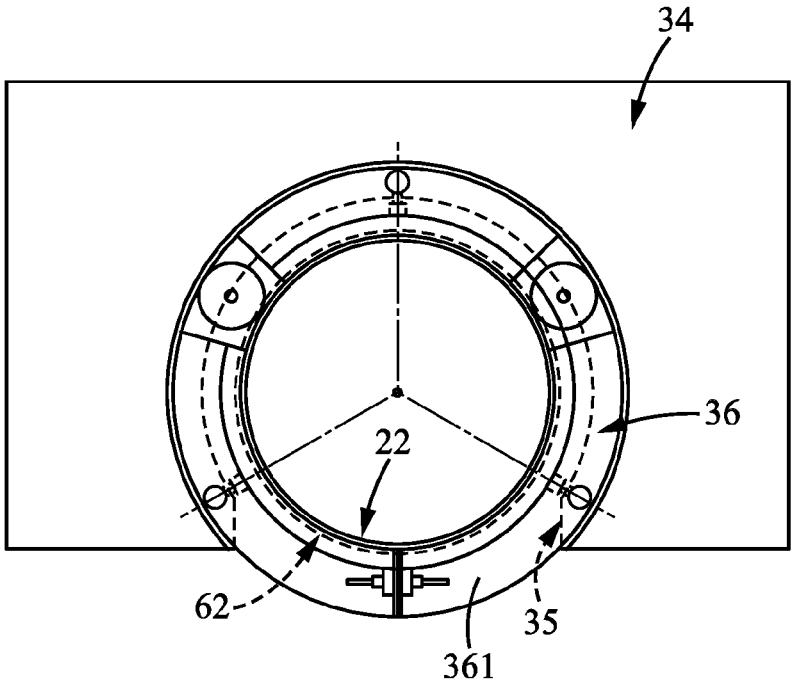
FIG. 1*d* illustrates a bottom view of a front support of the girder of FIG. 1*c*.
Figure 1E:
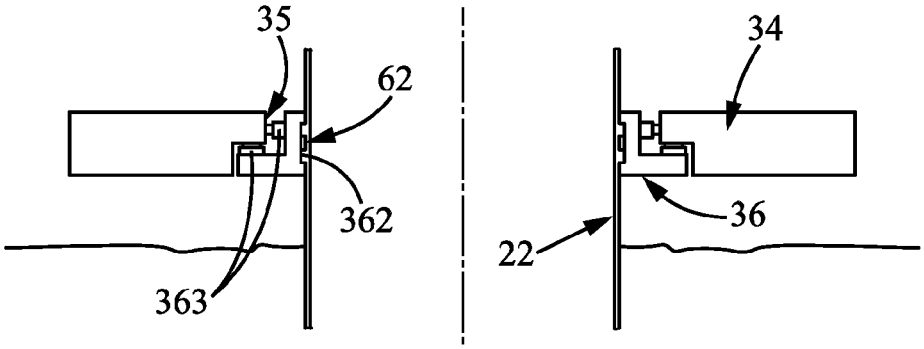
FIG. 1*e* illustrates a side view of the front support of FIG. 1*d*.

In reference to FIGS. 1*d* and 1*e*, the front support 32 comprises a bearing system 36 configured to be connected to the cofferdam 22. The bearing system 36 is configured to monitor and adjust both the geometrical and load configurations of the interface between the front support 32 and the cofferdam 22. In other words, the bearing system 36 detects and corrects the relative position of the cofferdam and the support 32 as well as compensate for the loads and forces applied by the support 32 to the cofferdam 22. The bearing system 36 is located beneath the floor plate 34. The bearing system 36 comprises a ring structure 361 configured to cooperate with a circumferential sleeve flange on the cofferdam 22. The ring structure presents a L-shaped section with an inner recess 362 configured to receive the sleeve flange of the cofferdam. The ring structure 361 is laid out around the opening 35 substantially concentrically with the opening 35. The ring structure 361 faces the walls of the opening 35 and the lower portion of the ring structure is engaged below a circular shoulder arranged around the opening 35. The ring structure 361 further comprises horizontal and vertical jacks 363 laid out on the L section so as to come in contact with the floor plate 34 around the opening 35 in the closed configuration. These jacks are respectively configured to adjust the horizontal and vertical loads applied by the girder to the cofferdam, as well as adjust the geometry of the interface between the bearing system 36 and the cofferdam. For instance, the bearing system 36 comprises three horizontal jacks and three vertical jacks laid out all around the ring structure. The ring structure 361 is further articulated so as to move between an open configuration in which the cofferdam is allowed through the opening 35, and a closed configuration in which the ring structure 361 cooperates with the sleeve flange and locks it into position inside the opening 35 and concentrically therewith. For instance, to move from one configuration to the other, the ring structure is slightly opened so as to release or let the cofferdam through, or, on the contrary, fully closed in a ring shape around the sleeve flange.

In addition, the front support 32 comprises a bracket 37 configured to be connected to pier elements so as to allow the girder to rest on pier elements. The bracket 37 is located beneath the floor plate 34. For instance, the bracket 37 comprises deployable frame elements supporting an attachment mechanism configured to be secured to pier elements, in particular to pier columns.

Figure 2:
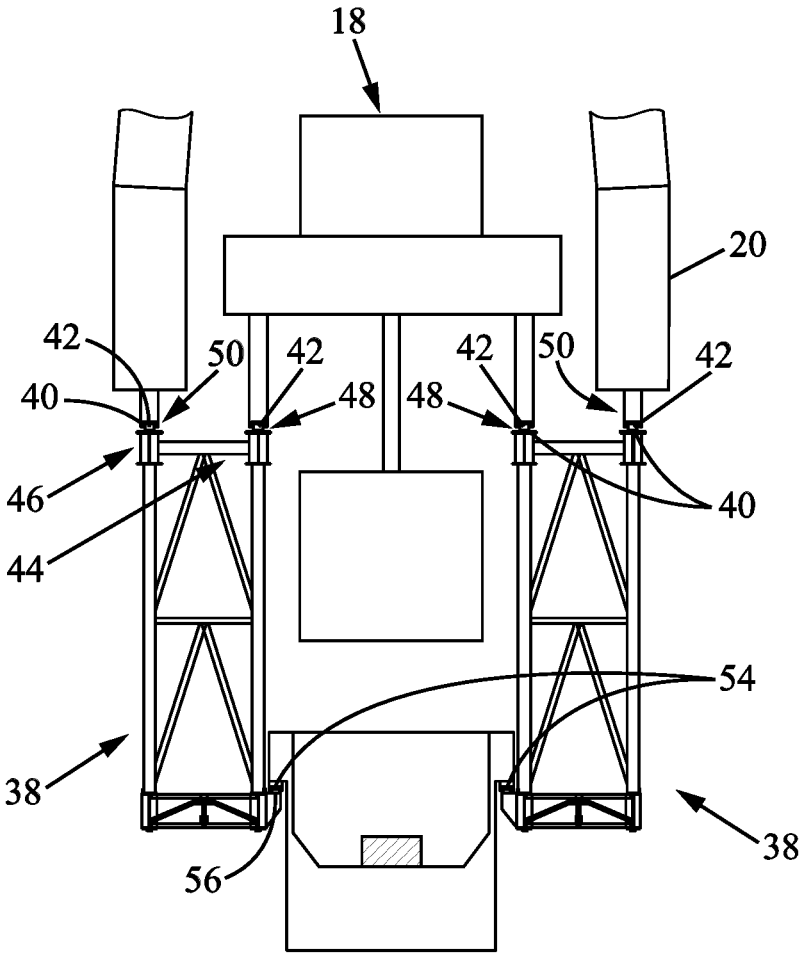
FIG. 2 is a section view of a girder of the apparatus of FIG. 1.
Figure 2:
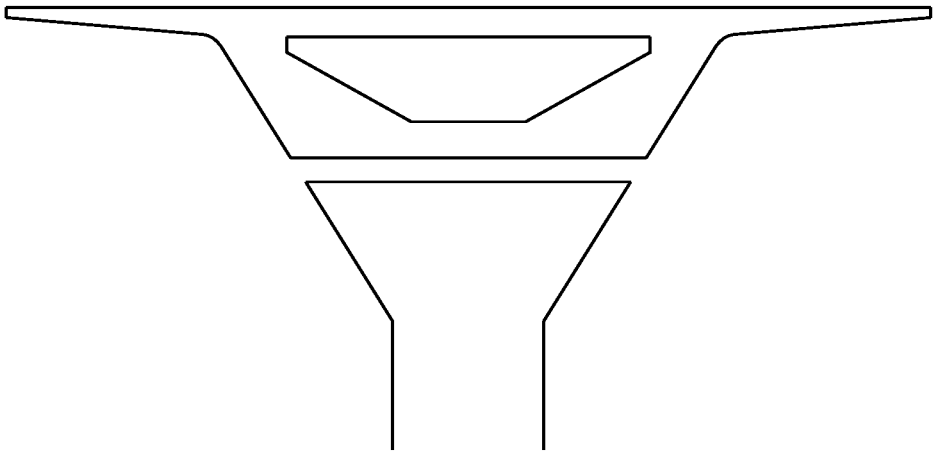

As illustrated by FIG. 2, the girder 16 comprises two parallel beams 38. The beams 38 are made of steel. Each beam 38 is in the form of a truss. In the example of FIG. 2, each beam 38 comprises a set of beams laid out so as to form a hollow frame having a rectangular-shaped section along the longitudinal axis of the girder. These frames are reinforced with beams laid out in triangles within them. Alternatively, the beams 38 may be in the form of box girders, or in any form known to the man skilled in the art.

According to one aspect of the invention, the girder 16 further comprises guides 40 extending between the first 24 and second ends 26 of the girder 16 and along which the lifting devices 18, 20 are movable. The guides 40 are configured to allow the lifting devices 18 and 20 to cross one another along the girder 16. This configuration allows for an enhanced freedom of movement of the two lifting devices 18, 20 along the girder 16. More specifically, while in operation, this configuration greatly reduces the need for downtimes associated with having to clear one of the lifting device out of the way of the other lifting device. This translates into a reduced building duration overall.

The guides 34 comprise a set of rails 42 that defines two independent running tracks 44, 46 which each extend between the first and second ends of the girder 16. More precisely, these two tracks extend between the extremities of the girder 16. Each track is respectively associated with one of the lifting devices 18, 20. The running tracks 44, 46 are both located on top of the girder. Alternatively, the running track 44 of the first lifting device 18 is located beneath the running track of the second lifting device.

The set of rails 42 thus comprises a first pair of rails 48 and a second pair of rails 50 that form running track 44, respectively running track 46. These pairs of rails 48, 50 are laid out in parallel on the beams 38. Each beam 38 supports one rail from the first pair 48 and one rail from the second pair 50. The two rails of the first pair 48 are located internally relative to the two rails of the second pair 50. The first lifting device 18 is movable along the first pair 48, while the second lifting device 20 is movable along the second pair of rails 50. As a consequence, the first and second lifting devices 18, 20 can cross each other at any point along the girder 16. In addition, when the lifting devices 18, 20 cross each other, the first lifting device 18 passes underneath the second lifting device 20 (FIG. 2). Therefore, both the tracks and the lifting devices 18, 20 occupy a minimal amount of space on the girder 16, especially while crossing, and thus have a limited impact on the design and the structural requirements of the girder 16.

The girder 16 further comprises a movable storage rack 52 provided to move construction tools between the constructed zone 12 and the construction zone 14. The rack 52 is mounted on the girder 16 and is movable along the girder 16. For instance, the construction tools comprise a vibrohammer configured to help bury the cofferdam and the steel piles in the soil in the construction zone 14, a grab adapted to remove soil material from inside the cofferdam, and a lifting frame configured to extract the cofferdam from the seabed. The presence of this movable rack allows for minimized movements of the lifting devices whenever they are due to pick up something from the rack as the rack can be moved to meet the lifting devices, thereby reducing the overall bridge-building duration. In addition, the rack 52 can serve as an adjustable counterweight, and be moved along the girder 16 whenever required. Moreover, its impact on the movements of the lifting devices 18, 20 is minimal. In addition, as it does not need to be stored at a particular point along the girder, the movable rack allows for a reduced length of the girder 16, which can therefore be reduced to a length of three spans. Preferably, the rack 52 is in the form of a cradle. In other words, the rack 52 presents both lateral and transverse walls that can be laid out so as to define between them a compartment only accessible from atop. This particular form helps prevent the inadvertent fall of objects the rack may contain while moving.

The rack 52 is independent of the lifting devices, i.e. the rack can be moved along the girder 16 regardless of the lifting devices' configuration. To that end, the rack is provided with wheels or rollers 54 movable along a separate track 56 which extends along the girder between the first end 24 and the second end 26 of the girder 16. For instance, the separate track 56 is distributed between the two beams 38 and is located below the tracks of the lifting devices 18, 20 (FIG. 2).

The girder 16 further comprises one or more guiding frames 58 (FIG. 1) located at the second end 26. For example, the girder 16 comprise a top guiding frame 58T arranged on the beams 38, and a bottom guide frame 58B located on the front support 32. The guiding frames 58 are configured to guide the piles and the cofferdam vertically and through the front support 32 during their respective installation in the construction zone 14. Each guiding frame 58 comprises a plate presenting a U-shaped opening whose dimensions substantially correspond to those of the steel piles. Preferably, each guiding frame 58 is provided with a hinge connection on the girder or the front support. The frames 58 can then be lifted when they are not needed, so that their overall bulk is minimized In addition, preferably, the position of the guiding frames 58 is adjustable laterally so as to tolerate for slight relative position errors of the steel piles.

The first and second lifting devices 18, 20 are configured to move the deck segments 10 and the pier elements between the constructed zone 12 and the construction zone 14. In particular, they are adapted to pick up bridge elements on the constructed zone 12 of the bridge, lift these elements and then move them to their destination along the girder 16. The lifting devices 18, 20 comprise one or more engines adapted to move the associated lifting device relative to the girder 16. The lifting devices 18, 20 also comprise a lifting mechanism, such as one or more winch. Preferably, the lifting devices 18, 20 are both gantry cranes with different respective sizes. For instance, the first lifting device 18 presents a box shape made of frames defining see-through sides. For instance, the second lifting device 20 presents two triangle-shaped sides connected to each other by a top frame. As indicated above, the first device 18 moves along the internal track 44 whereas the second device 20 moves along the external track 46. The first lifting device 18 is smaller than the second lifting device 20. The lifting devices 18, 20 have dimensions adapted to allow the first lifting device 18 to pass beneath the second device 20 between the sides, i.e. between the legs, of the second lifting device 20 when the two devices move along their respective track 44, 46.

The first lifting device 18 is more precisely adapted to:

- pick up, rotate, move and lower the rear support bearings 28, 29 and the intermediate support bearing 30,
- pick up, move and lower the cofferdam 22,
- pick up, move and set up deck and pier segments and piles
- pick up, move and set up the lifting frame located in the storage rack 52,
- pick up, move and tilt the piles together with the second lifting device, and
- serve as a counterweight.

The second lifting device is more precisely adapted to:

- pick up, move and lower pier elements including the steel piles,
- pick up, move and lower a vibro-hammer stored in the rack 52,
- pick up, move and lower a hydro-hammer stored in the constructed zone 12, and
- serve as a counterweight.

Preferably, the apparatus 2 only comprises the first and second lifting devices 18, 20, and does not include any other lifting device, such as another small gantry crane, or another big gantry crane. The overall bulkiness and cost of the apparatus 2 are therefore minimized.

The cofferdam 22 is adapted to be partly inserted in the soil or seabed in the construction zone 14 and define a dry enclosure within which the installation of pier elements, such as the pile 6A, is carried out. In addition, the cofferdam 22 is adapted to be attached to the girder 16 and serve as a support for the girder 16. To that end, the cofferdam 22 comprises a watertight casing having a cylindrical shape. For instance, the casing is made of a single metal sheet. This further increases the tightness of the cofferdam 22 as well as its sturdiness. In addition, the cofferdam 22 presents a locking mechanism 62 located on its top and adapted to cooperate with the bearing system 36. The locking mechanism 62 comprises a circumferential sleeve flange located near the top of the cofferdam 22. As indicated above, the sleeve flange is adapted to be grabbed by the bearing system 36. In some embodiments, the cofferdam 22 further comprises structural reinforcement components, such as vertical and/or circumferential reinforcing beams 63. These components strengthen the cofferdam 22 and help reduce deformations that may occur while it is used as a support for the girder 16.

A method for building a bridge 2 will now be described in view of the Figures.

Figure 4:
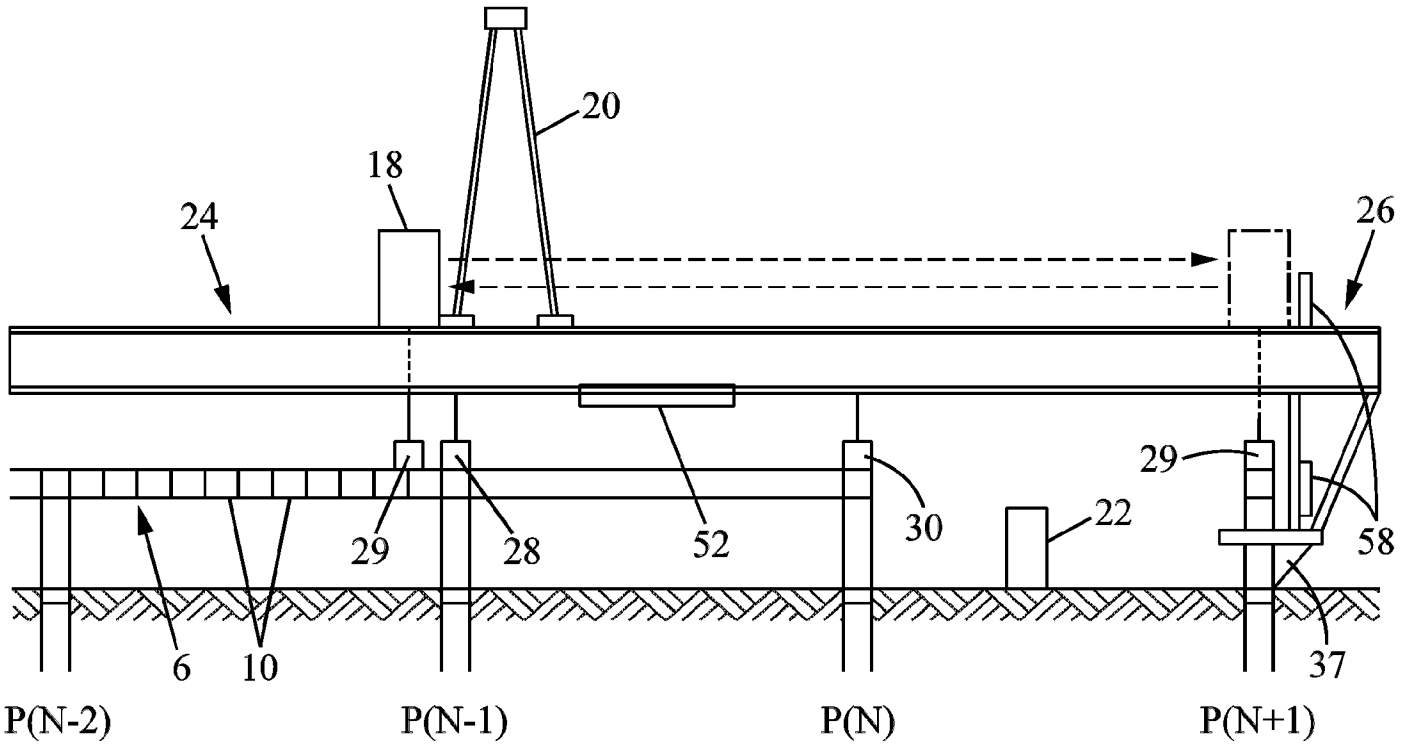
FIGS. 4 to 7 are side views of the bridge-building apparatus of FIG. 1.
Figure 3:
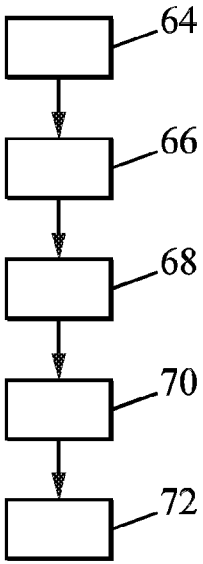
FIG. 3 is a schematic diagram of a bridge-building method according to the invention.

Initially, at step 64 (FIG. 3), and as illustrated by FIG. 4, the constructed zone 12 of the bridge 2 extends up to pier P(N), and the construction zone 14 extends from pier P(N) to pier P(N+1), pier P(N+1) having been erected. Both of the lifting devices 18, 20 overhang the constructed zone 12, the first device being slightly to the left of the second device. For instance, the devices 18, 20 more or less overhang pier P(N−1). The front support 32 rests on pier P(N+1) via the bracket 37. The rear bearings 28, 29 rest on the constructed zone 12 as well. For instance, a first rear bearing 28 rests on the pier segment of pier P(N−1). The second rear bearing 29 is located adjacent to the first rear bearing 28. In addition, the cofferdam 22 is stored on the sea bed between piers P(N) and P(N+1). The rack 52 is located between piers P(N−1) and P(N) above the deck.

At step 66, the supporting arrangement of the girder 16 is modified. More specifically, the first lifting device 18 picks up one of the rear support bearings, for instance second rear bearing 29, rotates it then moves it to the second end 26 of the girder 16 by following its track 44, then lowers it on top of pier P(N+1) which is located underneath the second end 26 of the girder. While doing so, the first lifting device 18 crosses the second lifting device 20, and passes underneath the latter, as explained above. The second end 26 of the girder 16 is then laid to rest on bearing 29. The first lifting device 18 is then moved back to its former position over the constructed zone 12.

Figure 5:
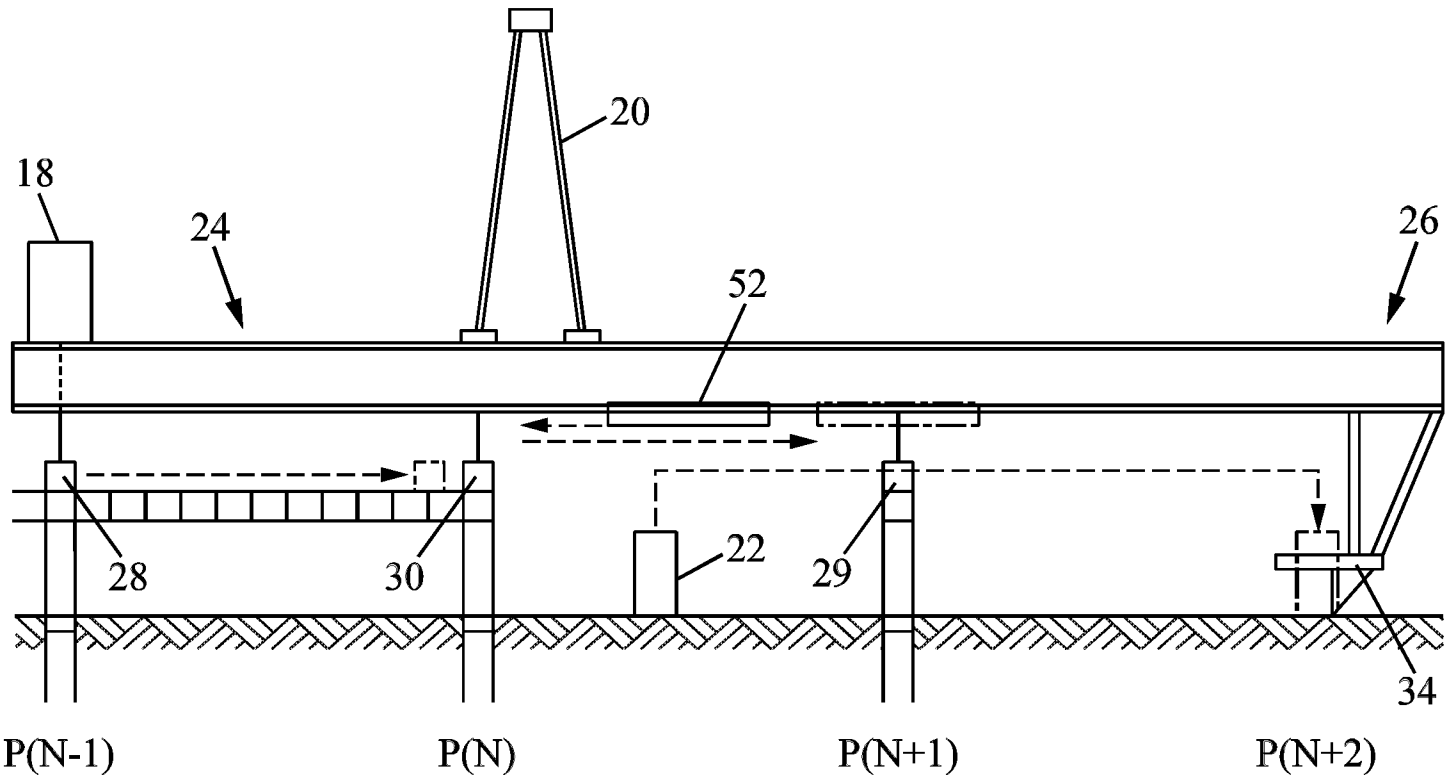

At step 68, the girder 16 is cantilevered, or "launched". In other words, the girder 16 is moved relative to its bearings 28, 29, 30, the second end 26 being moved towards the area where pier P(N+2) is to be erected. To that end, the first lifting device 28 is attached to the constructed zone 12 over pier P(N−1) and is connected to the support bearing located on top of pier P(N−1), that is support bearing 28 on FIG. 5. Its winch and/or its engine is then used to launch the girder 16. The positioning of the lifting device 18 then also compensates for the cantilever moment generated by the projection of the girder beyond pier P(N+1). The resulting configuration is illustrated by FIG. 5. After the launch of the girder 16, the second end 26 overhangs the construction zone 14, and more precisely, the second end 26 of the girder is above the area of future pier P(N+2). It should be noted that during the cantilevering of the girder 16, the second lifting device 20 and the rack 52 are kept immobile relative to the girder 16. The rear support bearing 28 located above pier P(N−1) is then picked up by the first lifting device 18 and placed next to the intermediate support bearing 30 before being used as a support bearing once more.

At step 70, still in reference to FIG. 5, the cofferdam 22 is set up at the area of pier P(N+2). To that end, the rack 52 is first moved towards the first end 24 so as to free up the space above the cofferdam located between piers P(N) and P(N+1). The cofferdam 22 is then picked up by the first lifting device 18, moved toward the second end 26 of the girder 16, then lowered through the opening 35 of the floor plate 34 onto the seabed. Then, the rack 52 is moved toward the second end 26, and more precisely above pier P(N+1) for balancing the loads applied to the girder 16. The first lifting device 18 then picks up the vibro-hammer from the rack 52, and uses it to drive the cofferdam 20 into the seabed at the location of future pier P(N+2). The vibro-hammer is then put back into the rack 52 by the first lifting device 18, which is then moved over the constructed zone 12. It then crosses the second lifting device 20 once more. During these operations, the second lifting device 20 is kept immobile above pier P(N). Once the cofferdam is driven into the seabed, the front support 32 is set in locked configuration with the cofferdam and is set to rest on the cofferdam. From there on, the cofferdam serves as an additional support for the girder 16. In addition, the bearing forces applied by the girder to the cofferdam are then monitored and compensated for by the bearing system 36 which therefore maintains these resulting bearing forces on the cofferdam within a desired range, thereby preventing the cofferdam from being excessively settled into the seabed or the ground.

Figure 6:
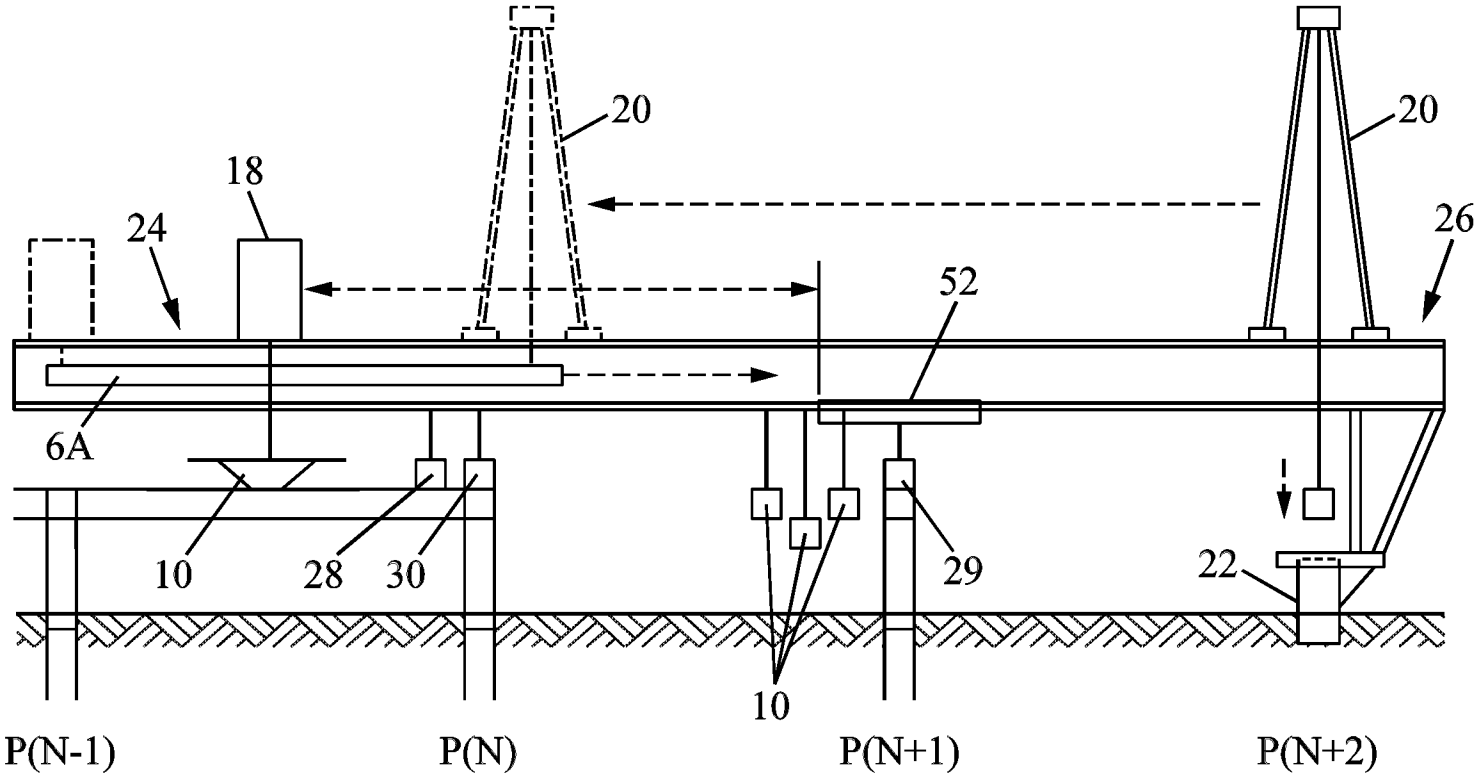
Figure 7:
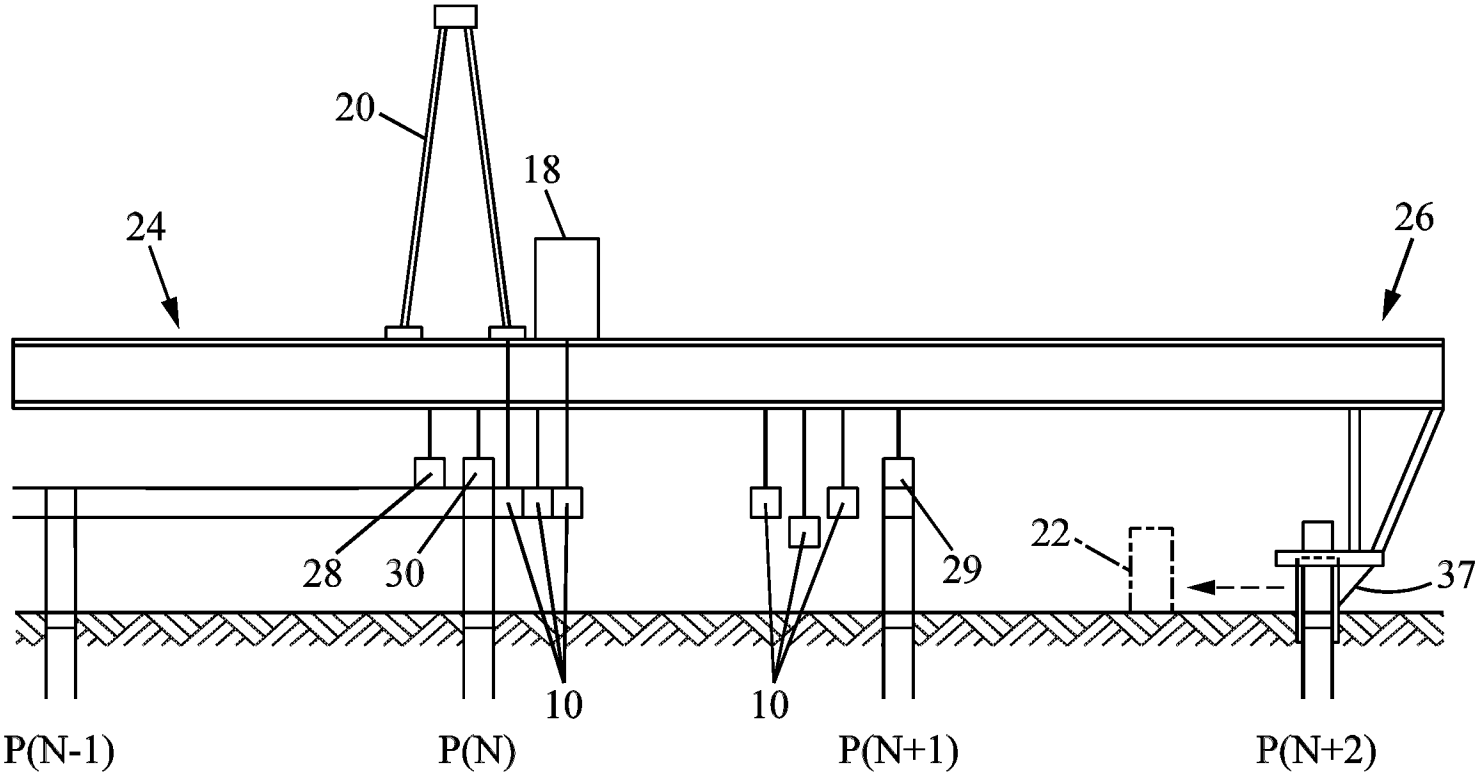

In view of FIG. 6, at a construction step 72, the installation of part of the deck elements via the first lifting device 18 and, at the same time, the installation of part of the pier elements via the second lifting device 20 are carried out. In addition, pier elements are installed inside the cofferdam 22. More precisely, the second lifting device 20 is used to pick up the grab located in the rack, and to move it into the cofferdam for the removal of soil material from within the dry enclosure the cofferdam defines. In parallel, the installation of deck segments between piers P(N) and P(N+1) is carried out with the first device 18. More precisely, the first lifting device 18 picks up deck segments 10 that are brought to the constructed zone 12, lifts them then moves them over to their destination, rotates them, then hangs them in two rows which each comprise every other segment brought by the first device 18. When the soil material has been removed using the grab, the second lifting device 20 returns it to the rack 52, and moves back to the first end 24 with a view of pick up the steel pile of pier P(N+2) from the constructed zone 12. The first lifting device temporarily stops the deck building works, and also moves to the first end 24. The lifting devices 18, 20 both pick up the pile 6A laid out horizontally on the constructed zone 12, then move it to the second end 26. The second lifting device is positioned above the cofferdam 22. While being secured to the second lifting device 20, the pile is then tilted vertically by the first lifting device 18 which is moved towards the second lifting device 20, the rack being temporarily moved back towards the constructed zone 12 before being brought above pier P(N+1) again. The pile is then lowered onto the seabed inside the cofferdam 22, and kept in place by the guiding frames 58, which have been lowered. The first lifting device 18 is immediately returned to the deck works, while the second lifting device 20 is used to finish the installation of the steel pile of pier P(N+2). To that end, it is used to pick up the vibro-hammer from the rack 52 and to partially drive the pile into the seabed with the latter. The vibro-hammer is then returned to the rack 52, and the second lifting device 20 is moved above the constructed zone 12 to pick up another pile driving tool, such as a Hydro-Hammer. The first lifting device is steered clear of the second lifting device's path, and is for instance moved to the extremity of the first end 24 of the girder 16. The pile is then driven into the seabed at the required depth by the second lifting device 20 using the pile driving tool, while the first device 18 keeps setting up deck segments 10 as described above. A reverse operation by which the pile driving tool is returned to the constructed zone 12 is then carried out, the first lifting device 18 being moved out of the way of the second lifting device 20 once more. While above the constructed zone 12, the second lifting device 20 is used to pick up the pier column of pier P(N+2) from the constructed zone 12 whereas the first lifting device is returned to deck works, thereby crossing the second lifting device 20 along the girder 16 once more. In the meantime, the pile cap is formed inside the cofferdam, for instance with reinforced concrete, then the pier column is installed. Once the pier column is installed, the second lifting device 20 is returned above pier P(N), thereby crossing the first device 18. The lifting device 18 is then used to position the deck segments 10 in their final configuration and to carry out the stitching and concrete works of the segments to the piers P(N) and P(N+1), and more precisely to their pier segments. The rack 52 is then moved precisely above pier P(N+1), and the stressing and the grouting of the tendons of the deck segments recently set up are carried out. The first lifting device 18 then picks up the lifting frame from the rack 52 and places it on top of the installed elements of pier P(N+2). The lifting frame then lifts (or pulls out) the cofferdam 22 from the seabed, and, via the lifting frame still holding the cofferdam, the first lifting device 18 then moves the cofferdam to the seabed between piers P(N+1) and P(N+2). The bracket 37 of the front support 32 is then connected to the pier elements of pier P(N+2) that have been set in place, such as the pier column, and then acts as a support for the girder. In the meantime, the lifting devices 18, 20 pick up the remaining elements to finish pier P(N+2): the second lifting device 20 is used to install the pier cap on top of the pier column, and the first lifting device 18 is used to install the pier segment on top of the pier cap. At the end of this step, the configuration is similar to the initial configuration, a new pier and a new deck span having been installed.

These above steps are then repeated until completion of the bridge 2.

The apparatus and method according to the invention present several advantages, some of which have been mentioned above. In particular, the general configuration of the apparatus, and in particular the use of a girder overhanging the construction zone 14 to move the bridge elements between the constructed zone and the construction zone prevents any undesired harm that may be caused to the flora or fauna harbored in the construction zone, as the apparatus does not rely on ships which usually damage the seabed especially in shallow waters. In addition, the apparatus allows for a simpler and more efficient way of building bridges, as it exhibits two lifting devices whose freedom of movement relative to the other lifting device is enhanced by the presence of independent tracks 44, 46. This aspect is particularly visible during the construction step, during which the lifting devices switch from a configuration in which the first device is at the second end of the girder above the construction zone and the second device is at the first end of the girder above the constructed zone of the bridge, to a reverse configuration in which the second lifting device is at the second end of the girder above the construction zone whereas the first device is at the first end of the girder in the constructed zone.

Moreover, the bridge-building apparatus is thus adapted for carrying out both the pier works and the deck works, and therefore suppresses the need for two separate systems each dedicated to one of these aspects.

In addition, the presence of the movable rack 52 yields several positive effects, as it can be moved towards the lifting device which needs to access its content and thereby minimizes the overall movements of the lifting devices 18, 20 along the girder 16. In addition, the impact of the rack on the movements of the lifting devices is in turn reduced, as it can be moved around to free up space, for instance for the picking up of the cofferdam from the seabed. Moreover, it can be used as an additional counterweight whose position along the girder is adjustable, thereby limiting the structural constraints on the girder and on its balance properties. In particular, the overall length of the girder can be reduced. The use of the cofferdam as a support for the girder then increases the stability properties of the girder without requiring the use of additional support bearings laid out on the constructed elements of the bridge. The use of the bracket 37 whenever using the cofferdam as a support is not possible also improves the overall stability of the girder 16. In addition, the presence of the bearing system 36 increases the reliability of using the cofferdam as a support, in particular during construction phases during which the second lifting device is above the construction zone and carries heavy pieces of equipment such as a steel pile or carries out pile driving tasks with a hydro-hammer of a vibro-hammer.

Many modifications and variations of the present invention are made possible in the light of the above teachings. It is therefore to be understood that within the scope of the appended claims, the invention may be practiced otherwise than as specifically described.

The invention claimed is:

1. A method for building a bridge, said bridge comprising piers and at least one deck, the method comprising:

a cantilever step, wherein a girder is set in a cantilevered position relative to a bank or to a constructed zone of the bridge so that the girder comprises a first end overhanging the bank or the constructed zone, and a second end overhanging a construction zone of the bridge, and a construction step, wherein pier elements and deck elements are installed in said construction zone via a first and a second lifting devices movably mounted on the girder between the first and second ends, wherein the first and second lifting devices cross one another along the girder during the cantilever step and/or during the construction step.

2. The method according to claim 1, wherein the construction step comprises the installation of part of the deck elements via the first lifting device and, at the same time, the installation of part of the pier elements via the second lifting device.

3. The method according to claim 1, wherein construction tools are moved along the girder by a movable rack mounted movable on the girder.

4. The method according to claim 1, further comprising:

installing a cofferdam in the construction zone of the bridge;

setting the second end of the girder on the cofferdam so that said second end rests on the cofferdam; and installing pier elements in the cofferdam.

5. The method according to claim 4, wherein during at least part of the installation of the cofferdam, the second lifting device is located at the first end of the girder and the first lifting device is located at the second end of the girder, and, during at least part of the construction of said pier, the second lifting device is located at the second end of the girder and the first lifting device is located at the first end of the girder.

6. A method for building a bridge, said bridge comprising piers and at least one deck, the method comprising:

a cantilever step, wherein a girder is set in a cantilevered position relative to a bank or to a constructed zone of the bridge so that the girder comprises a first end overhanging the bank or the constructed zone, and a second end overhanging a construction zone of the bridge;

a construction step, wherein pier elements and deck elements are installed in said construction zone via a first and a second lifting devices movably mounted on the girder between the first and second ends, wherein the first and second lifting devices cross one another along the girder during the cantilever step and/or during the construction step;

installing a cofferdam in the construction zone of the bridge;

setting the second end of the girder on the cofferdam so that said second end rests on the cofferdam; and installing pier elements in the cofferdam, wherein a bearing system configured to monitor and adjust the geometrical and/or the load configuration of the interface between the girder and said cofferdam is arranged between the cofferdam and the girder for the installation of pier elements.

7. A bridge-building apparatus, said bridge comprising piers and at least one deck, said apparatus comprising:

a girder having a first end configured to overhang a bank or a construction zone of the bridge, and a second end configured to overhang a construction zone of the bridge, and a first and a second lifting devices movable on guides laid out on the girder between the first and second ends for moving pier elements and deck elements between the constructed zone and the construction zone of the bridge, said guides being configured to allow the crossing of the first and second lifting devices along the girder.

8. A bridge-building apparatus according to claim 7, wherein said guides comprise a set of rails defining at least two independent running tracks between the first and second ends of the girder.

9. A bridge-building apparatus according to claim 7, wherein the girder comprises a storage rack, the storage rack being independent of the lifting devices and movable along the girder, said storage rack being adapted to move construction tools along the girder.

10. A bridge-building apparatus according to claim 7, wherein the girder has a length corresponding to substantially three times the distance between two consecutive piers of the bridge.

11. A bridge-building apparatus according to claim 7, wherein the girder comprises at least one guiding frame for the vertical guiding of pier elements, said guiding frame being located at the second end of the girder.

12. A bridge-building apparatus according to claim 7, wherein the girder comprises a front support adapted to rest on a cofferdam in the construction zone, the front support comprising a bearing system configured to monitor and adjust the geometrical and/or the load configuration of the interface between the girder and said cofferdam.

* * * * *